United States Patent [19]

Lutz

[11] Patent Number: 5,056,158

[45] Date of Patent: Oct. 15, 1991

[54] BASEBALL CATCHER'S HAND PROTECTOR

[75] Inventor: John F. Lutz, N. Redington Beach, Fla.

[73] Assignee: Liberty Bell Sports Equipment, Inc., N. Redington Beach, Fla.

[21] Appl. No.: 686,816

[22] Filed: Apr. 17, 1991

[51] Int. Cl.[5] ..... A41D 13/00

[52] U.S. Cl. ..... 2/22; 2/16; 2/19; 2/2

[58] Field of Search ..... 2/22, 23, 24, 16, 19, 2/2; D29/20; 273/25

[56] References Cited

U.S. PATENT DOCUMENTS

| | | | |
|---|---|---|---|
| D.337,084 | 6/1943 | Giardini | 2/22 |
| 1,801,437 | 4/1931 | Lown et al. | 2/22 |
| 3,135,964 | 6/1964 | Pender | 2/22 |
| 3,761,960 | 10/1973 | Woodcock | 2/22 |
| 4,572,545 | 2/1986 | Dooley | 280/821 |
| 4,765,617 | 8/1988 | Groves | 273/25 |
| 4,807,302 | 2/1989 | Cannella | 2/16 |
| 4,888,826 | 12/1989 | Parsons, Jr. | 2/22 |
| 4,999,847 | 3/1991 | Barcelo | 2/24 |

*Primary Examiner*—Werner H. Schroeder
*Assistant Examiner*—Gloria Hale
*Attorney, Agent, or Firm*—Pettis & McDonald

[57] ABSTRACT

A protective device for the throwing hand of a baseball catcher. The device is used with a catcher's leg protector that is mounted on the catcher's leg that corresponds to his throwing hand. The device comprises at least one substantially rigid member that is supported on the leg protector and has as least one portion that extends away from the leg of the catcher to permit placement of at least part of the throwing hand of the catcher between the leg of the catcher and one portion of the device, so that such portion of the device is interposed between pitched balls and the throwing hand of the catcher.

11 Claims, 3 Drawing Sheets

BASEBALL CATCHER'S HAND PROTECTOR

FIELD OF THE INVENTION

This invention relates to protective devices in the field of sports, and more particularly to protective devices for baseball catchers.

BACKGROUND OF THE INVENTION

Due to the fragility of hand bones and their intricate interrelationship with cartilage and tendons, the hands of those persons involved in sports are particularly susceptible to injury. Protective devices for hands have been developed in a number of sporting fields. For example, a protective hand shield for skiers, that is attached to ski poles, is disclosed in U.S. Pat. No. 4,572,545 issued to Dooley, Jr. et al. Also, a hand protector for those involved in martial arts sports is disclosed in U.S. Pat. No. 4,807,302 issued to Cannella. In baseball and softball the player position that is most susceptible to injury is that of the catcher, due to his location behind the batter, where he receives pitched balls at speeds of 90 miles per hour or more. In addition, when the pitched ball is tipped by the batter the rapid change of direction is difficult for the catcher to follow and exposes him to being struck by the ball.

Over the years numerous protective devices have been provided for the catcher, including leg protectors, also known as shin guards, such as those disclosed by U.S. Pat. No. 4,888,826 issued to Parsons, Jr. et al. and U.S. Pat. No. 3,135,964 issued to W. F. Pender. With all the current protective devices now being worn by catchers, the greatest number of injuries now occur to the catcher's throwing hand that remains exposed to the unpredictability of pitched and tipped balls. Currently there is no protective device for the throwing hand, due to the fear that such protective devices will be too restrictive and will impede movement and will thus increase the time it takes the catcher to retrieve the ball from his glove.

There is a tendency for a young player to reach for the ball with his throwing hand, to keep his hand too close to the catching mitt or to let his throwing hand float out at his side where it can be struck by a tipped ball or a wild pitch. In some leagues current practice requires that a young catcher keep his hand behind his back when awaiting a pitch, in order to keep his throwing hand protected. The young player finds that it is difficult to keep his hand behind his back, as this is an uncomfortable and unnatural position that makes it hard for the player to maintain his balance and hard to maintain control of the ball. Therefore, the young player has a tendency to allow his throwing hand to move forward and float along his side, exposing it to injury. Older players may not make the same mistakes as the younger, inexperienced players; however, through overconfidence or carelessness they are frequently struck in the throwing hand by tipped balls and wild pitches.

Such injuries to the hands of catchers shorten the length of their careers and may result in younger players being unable to continue playing the sport. There is a need for a means of protection which will be used by both the young inexperienced players and the older experienced players.

SUMMARY OF THE INVENTION

In view of the frequent failure of current protective practices and the large number of injuries to the throwing hands of catchers, it is an object of the current invention to provide such protection with little interference to the action of the game. The current invention keeps the throwing hand close to the mitt for quick access to the ball, and it provides a place for the player to grip, which helps the player maintain his balance and remember to keep his hand within the protective device. When the player's hand is within the protective device, the fleshy portion of the arm is turned toward the pitcher, which protects the elbow and other portions of the arm where bones are near the surface.

To achieve these and other objects that will become readily apparent to those skilled in the art, this invention provides a device that comprises at least one substantially rigid member that is supported on the leg protector of a catcher that corresponds with his throwing hand. At least one portion of this member extends away from the leg of the catcher to permit placement of at least a part of the throwing hand between the leg and that extended portion of the device. As a result, the device is interposed between pitched and tipped balls and the throwing hand of the catcher.

BRIEF DESCRIPTION OF THE DRAWINGS

Particularly preferred embodiments of the apparatus of this invention will be described in detail below in connection with the following drawings in which.

Similar reference characters refer to similar parts throughout the several views of the drawings. Different embodiments utilize reference numbers increased in increments of 100.

DETAILED DESCRIPTION

The protective device has been identified as a device for protecting the throwing hand of a baseball catcher; however, the device may also be used by softball catchers. A particularly preferred embodiment of the protective device is illustrated in FIGS. 1, 2, 2*a*, and 2*b*, in which the device is generally indicated as 10.

Figure 1:
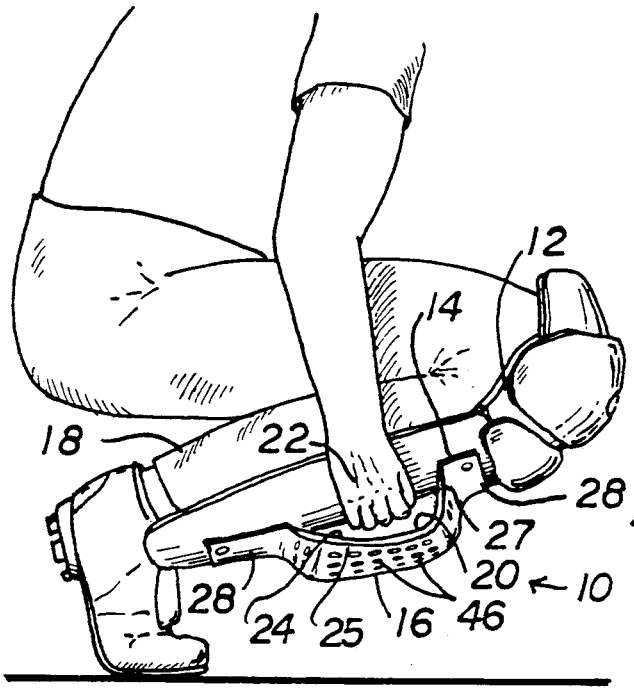
FIG. 1 is a right side elevational view of one embodiment of the protective device of the present invention, illustrating the device attached to a leg protector worn by a catcher.

The protective device 10 of FIG. 1 comprises at least one substantially rigid member 14 having at least one portion, conveniently shell 16, extending away from the leg 18 of the catcher. The shell 16, suitably combined with the leg protector 12, defines an enclosure having an open portion, which may be aperture 20, that permits the catcher to insert at least a part of his throwing hand 22 into the enclosure defined by the leg protector 12 and the shell 16. Aperture 20 has a periphery 24, and at least a portion of that periphery 24 preferably is flared outwardly forming a rounded lip 25. This lip 25 eliminates any sharp edges on the periphery 24 of the aperture 20. The periphery 24 of the aperture 20 is curved inwardly at the upper portion 26 of the shell 16 to form a widened aperture 20 to the enclosure.

Figure 2:
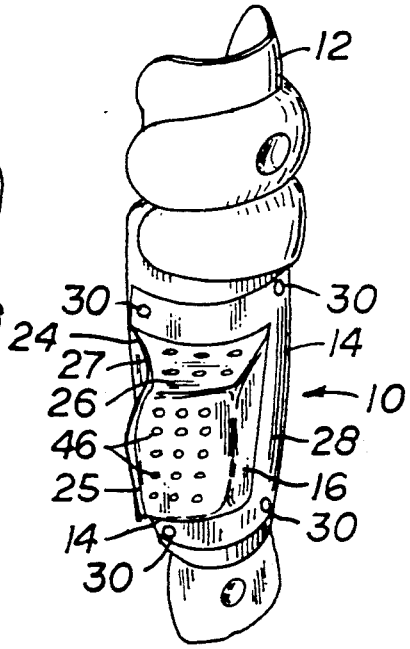
FIG. 2 is a perspective view of the protective device of FIG. 1 attached to a leg protector.
Figure 2A:
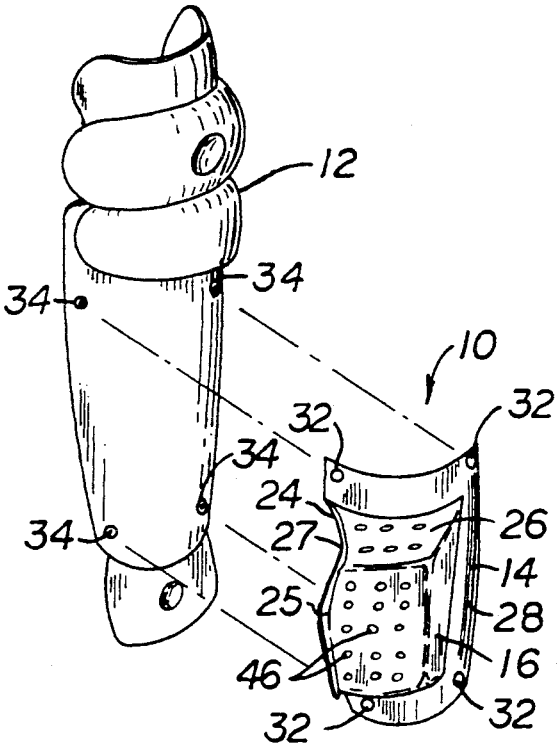
FIG. 2*a* is an exploded view of the protective device illustrated in FIG. 2 detached from the leg protector.
Figure 2B:
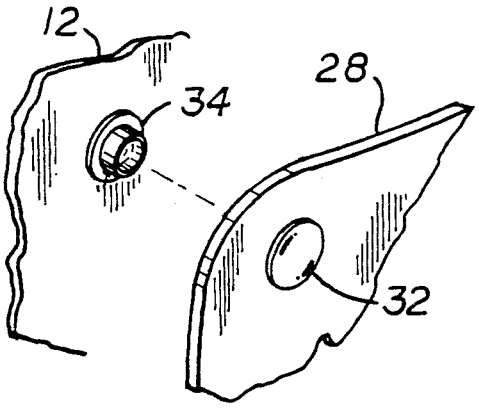
FIG. 2*b* is a fragmentary perspective view illustrating the attaching means for the protective device illustrated in FIGS. 2 and 2*a;*

The protective device may be affixed to the leg protector 12 by any means well known in the art, which means may conveniently be snap fasteners 32 and 34. FIGS. 1, 2, and 2*a* illustrate an embodiment of the protective device 10 that is removable from the leg protector 12. A flange 28 extends outwardly from a portion of the shell 16 as a part of the affixing means. The flange 28 is formed generally to conform to the shape and to supportably engage the leg protector 12. FIG. 2*a* shows the protective device 10 detached from the leg protector 12. FIG. 2*b* discloses one of four snap fasteners 30 having a first portion 32 and a second portion 34. The first portion 32 of the snap fastener 30 is attached to the flange 28 of the protective device 10, while a second portion 34 of the snap fastener 30 is attached to the leg protector 12. By joining the first portion 32 and second portion 34, the protective device 10 is removably attachable to the leg protector 12. Any well known attaching means that is suitable for the purpose may be used to attach protective device 10 to the leg protector 12, for example, hook and loop fasteners, nuts and bolts, or rivets may be used, or apertures may be formed in the flange so that straps may be passed therethrough as shown in FIG. 3, which illustrates another embodiment of the protective device 110.

Figure 3:
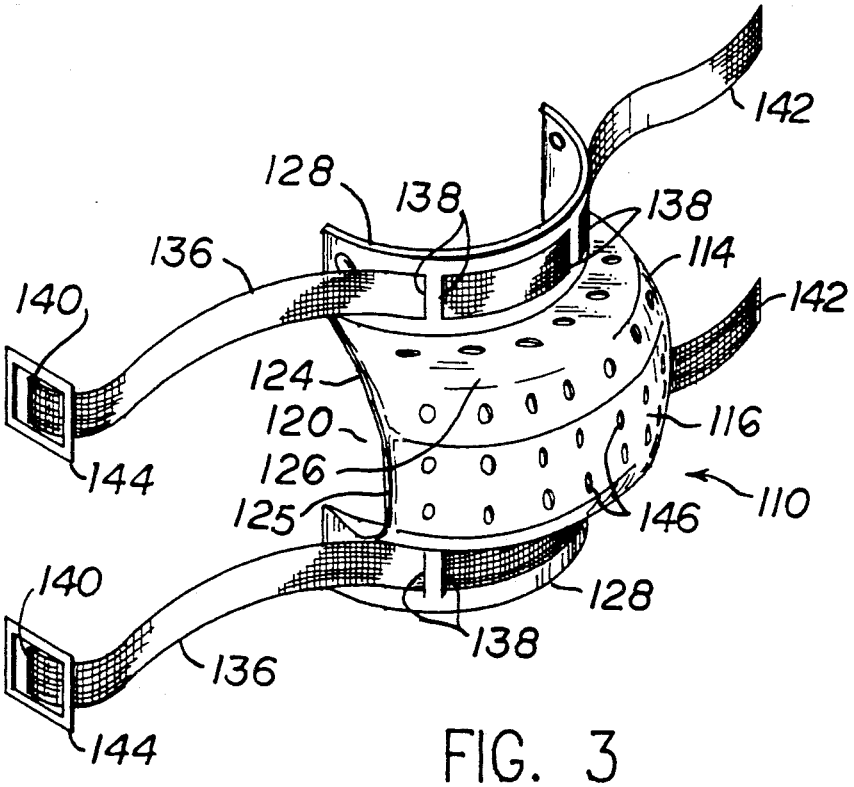
FIG. 3 is a perspective view of a second embodiment of the protective device of this invention.

A second preferred embodiment is illustrated in FIG. 3, and the same reference numbers in the 100s will be used to identify similar parts. The embodiment in FIG. 3 may be considered the youth model and the embodiments previously described in FIGS. 1, 2, 2*a*, and 2*b* may be considered the young adult or professional models. The youth model of the protective device 110 comprises a rigid member 114 that is further comprised of a shell 116 and a flange 128. The protective device 110 is mounted on a leg protector (not shown) so that the flange 128 rests against and conforms to the shape of the leg protector 112, forming an enclosure therebetween. The enclosure, defined by the leg protector (not shown) and the shell 116, has a single aperture 120 with a periphery 124. The periphery 124 has a portion that is flared away from the leg protector to form a lip 125. The protective device 110 is affixed to a leg protector by any suitable means, which may suitably include the straps 136 that are inserted through holes 138 in the flange 128. Each strap 136 has a first end 140 and a second end 142. The first end 140 has attached thereon a fastener 144, which may be either a buckle, as shown, or a Velcro fastener, or clips, or any other suitable form of fastener, so that the first end 140 and the second end 142 of a strap 136 may encircle the leg protector and the catcher's leg (not shown), so that the second end 142 of the strap 136 may engage the fastener 144 releasably attaching the protective device 110 to the leg protector.

The youth model of the protective device 110 may be smaller than the young adult model 10, because the hands of a young player are much smaller. Also, in youth leagues, base stealing is less common, so catchers generally remain in the fully crouched position shown in FIG. 1, such that extra room within the shell 116 for quick movement of the throwing hand is not required.

Figure 4:
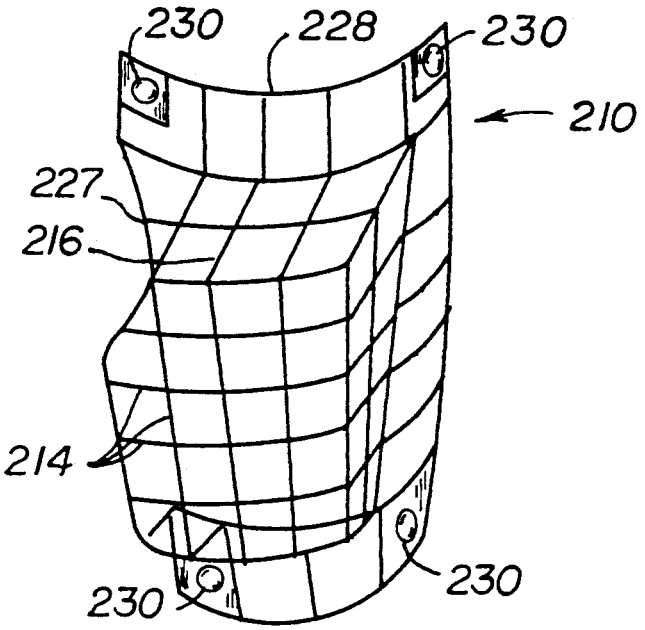
FIG. 4 is a perspective view of a preferred embodiment of the protective device of this invention.

FIG. 4 illustrates a third embodiment in which the same reference numbers will be used for the same elements as for FIG. 1, but incremented by 200. The protective device 210 is comprised of a plurality of substantially rigid members 214, such as wire or rod, that are formed in much the same configuration as the protective device 10. It may also be formed in the same configuration as the embodiment 110 shown in FIG. 3. The protective device 210 comprises a shell 216, flanges 228, an aperture 220 into the enclosure defined by the shell 216, a curved portion 227 of the periphery 324 of the aperture 320 and affixing means, conveniently snap fasteners 230. A plurality of wires have been used to keep the device lightweight and to permit airflow therethrough.

The protective devices formed from a single member may also be lightened by making a plurality of perforations 46, 146 and 346 through the respective shells 16, 116 and 316. These perforations 46, 146 and 346 also permit air flow therethrough.

Figure 5:
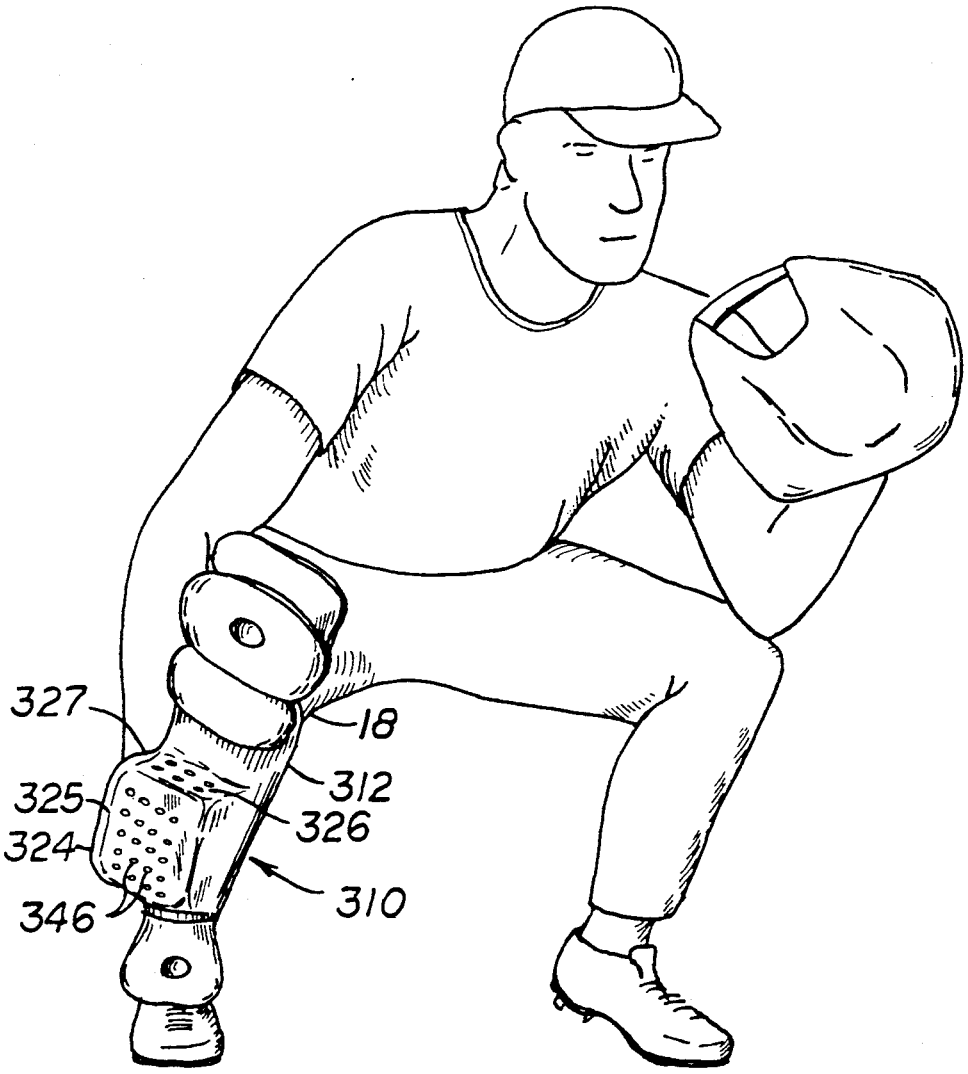
FIG. 5 is a perspective view of a fourth embodiment of the protective device of this invention integrally joined with a leg protector being worn by a catcher.

FIG. 5 illustrates a fourth embodiment in which the reference numbers are incremented by 300. The protective device 310 is integrally formed as a part of the rigid outer surface of the leg protector 312. The protective device 310 is comprised of a shell 316, an aperture (not shown) to provide access to the area enclosed between the leg protector 312 and the shell 316, and a curved portion 327 of the periphery 324 of the aperture 320. A lip 325 is formed on the peripheral edge 324 of the aperture.

While each of the preceding embodiments include a shell, other embodiments of the protective device may comprise a flat or curved member that does not comprise a shell-like structure, but is joined to the leg protector and projects laterally outwardly in relation to the catcher's body. The catcher may place his throwing hand so that the member is interposed between the pitched or tipped ball and his hand.

The protective device may be constructed from any suitable generally rigid material, including generally rigid plastics or metal, that is capable of resisting the force of a baseball traveling at high speed.

Having thus set forth four preferred constructions of the protective device 10 of this invention, it is to be remembered that these are but a few illustrative embodiments. Attention is now invited to a description of the use of the protective device 10. The protective device 10 may be integrally formed with the leg protector 12 during manufacture, as shown in FIG. 5, or it may be sold separately as an aftermarket add on, as shown in FIGS. 1 and 2, with an affixing means, so that the protective device may be removably attached to the leg protector 12. Once the protective device 10 has been attached to the leg protector, and the leg protector has been placed upon the leg 18 of the catcher that corresponds with his throwing hand 22, it is ready for use. Normally when the catcher receives a pitched ball he is in a full crouch, generally as shown in FIG. 1. The catcher places his hand 22 within the shell 16 grasping the leg protector 12 to help balance himself. In this position the protective device 10 has been interposed between the throwing hand of the catcher and a pitched or tipped ball. After receiving the ball the catcher may quickly remove his hand 20 from the protective device 10, retrieve the ball from his mitt and make the necessary throw. The lip 26 provides a smooth surface for the hand 20 to rub against when being pulled from the protective device 10.

When a player is on base, the catcher will move into a semi-crouch, generally as shown in FIG. 5, to receive the ball. His hand should remain within the protective device 310, but he will slide his hand upward toward the upper portion 326 of the device 310. In this position his arm will engage the curved portion 327 of the periphery 324 of the aperture (not shown). This permits the catcher to stand in a more upright position for faster movement and still permit his hand to remain comfortably within the protective device 310.

The embodiment shown in FIG. 4 is used in the same manner as the embodiments shown in FIGS. 1, 2 and 5.

The youth model of the protective device 110 has a smaller shell 116 than the shell 16 of the young adult or professional model 10, as the hands of the younger player are smaller. Also, in youth baseball a smaller shell 116 may be used, as base stealing is less common and the catchers generally need not move into the semi-crouch position. Since the youth player does not often move into the semi-crouch position, the curved cutout portion, similar to 27 shown in FIGS. 1, 2 and 4, is not required.

While the foregoing discloses four particularly preferred embodiments of the apparatus of this invention it is to be recognized that numerous variations and modifications, all within the scope of the present invention, will readily occur to those skilled in the art. All of such variations and modifications within the scope of the present invention are intended to be incorporated herewith, the invention being limited solely by the claims appended hereto.

What is claimed is:

1. A protective device for the throwing hand of a baseball catcher, said device being for use with a leg protector worn by catchers and being mounted on the catcher's leg that corresponds to the throwing hand of the catcher and comprising:

at least one substantially rigid member supported on said leg protector and having at least one portion thereof extending away from the leg of the catcher to permit placement of at least part of said throwing hand between the leg and said one portion such that said one portion of said device is interposed between pitched balls and the throwing hand of the catcher.

2. The protective device of claim 1 wherein said member comprises a shell defining an enclosure having an open portion for insertion of at least a part of said throwing hand thereinto.

3. The protective device of claim 2 wherein said open portion is defined by an aperture in said shell, said aperture having a periphery with at least a portion thereof flared away from said leg protector.

4. The protective device of claim 1 wherein said member is formed integrally with said leg protector.

5. The protective device of claim 1 wherein said member includes means for affixing said member to said leg protector.

6. The protective device of claim 5 wherein said affixing means includes flange means extending outwardly from said member and configured to supportably engage said leg protector.

7. The protective device of claim 5 wherein said affixing means comprise means for removably affixing said member to said leg protector.

8. The protective device of claim 7 wherein said affixing means comprise a plurality of snap fasteners, with one portion of each said fastener attached to said member and another portion of each said fastener attached to said leg protector.

9. The protective device of claim 7 wherein said affixing means comprises at least one strap attached to said member and releasably encircling said leg protector, whereby the device is worn by a catcher by fastening the strap around the leg protector and the adjacent leg.

10. A protective device for the throwing hand of a baseball catcher, said device being for use with a leg protector worn by catchers and being mounted on the catcher's leg that corresponds to the throwing hand of the catcher and comprising:

at least one substantially rigid member extending away from the leg of the catcher to define an enclosure, said enclosure having an aperture for insertion of at least a part of said throwing hand thereinto, said aperture having a periphery with at least a portion thereof flared away from said leg protector; and a means for affixing said member to said leg protector, said affixing means comprising;

a flange means extending outwardly from said member and configured to supportably engage said leg protector; and a plurality of snap fasteners with one portion of each said fastener attached to said member and another portion of each said fastener attached to said leg protector.

11. A protective device for the throwing hand of a baseball catcher, said device being for use with a leg protector worn by catchers and being mounted on the catcher's leg that corresponds to the throwing hand of the catcher and comprising:

at least one substantially rigid member formed integrally with a portion of said leg protector and having at least one portion thereof extending away from the leg of the catcher forming an enclosure having an aperture for insertion of at least a part of said throwing hand thereinto, said aperture having a periphery with at least a portion thereof flared away from said leg protector.

* * * * *